United States Patent [19]

Horian

[11] Patent Number: 4,827,796

[45] Date of Patent: May 9, 1989

[54] SECUREMENT BAND AND CONNECTOR MEANS THEREFOR

[76] Inventor: Richard Horian, 133 N. Swall Dr., Suite 401, Beverly Hills, Calif. 90211

[21] Appl. No.: 134,317

[22] Filed: Dec. 17, 1987

[51] Int. Cl.[4] ..... A44B 11/25

[52] U.S. Cl. ..... 24/584; 24/581

[58] Field of Search ..... 24/584, 580, 582, 581, 24/583, 585, 307, 265 WS, 163 K, 16 PB; 52/125.4

[56] References Cited

U.S. PATENT DOCUMENTS

| | | | |
|---|---|---|---|
| 215,956 | 5/1879 | Miller | 24/584 |
| 637,331 | 11/1899 | Flicek | 24/581 |
| 1,744,685 | 1/1930 | Nittel | 24/581 |
| 1,786,943 | 12/1930 | Gammell | 24/585 |
| 2,455,236 | 11/1948 | Darvie et al. . | |
| 2,521,903 | 9/1950 | Crapsey, Jr. et al. | 24/265 WS |
| 2,650,397 | 9/1953 | Nemser | 24/163 K |
| 3,349,450 | 10/1967 | Cattin | 24/583 |
| 3,385,299 | 5/1968 | Le Roy | 24/585 |
| 4,068,355 | 1/1978 | Rey . | |
| 4,288,892 | 9/1981 | Mardirossian | 24/307 |
| 4,292,692 | 10/1981 | Moretti et al. . | |
| 4,473,524 | 9/1984 | Paradis | 24/16 PB |
| 4,577,375 | 3/1986 | Beaussant | 24/580 |

*Primary Examiner*—Victor N. Sakran

*Attorney, Agent, or Firm*—Poms, Smith, Lande & Rose

[57] ABSTRACT

A securement band and connector therefor in which the securement band is flexible, uninterrupted along its width and in which locking holes are provided along longitudinal edges of the band. A connector for such a securement band in which one end of the band is fixed in a through passageway in a connector body and in which the free end of the securement band is adjustable to a range of positions within the connector body after the securement band has been cut to a selected length. A pivoted locking member is provided at a longitudinal edge opening of the connector body, the locking member having at one end or more locking pins movable in the plane of the band into locking engagement with the locking holes in the edge of the securement band. A keeper ring encircles the connecting body and locking member and is provided with an actuator lug which positively engages the lock member so that the lock member is moved into a locking position when the keeper ring is moved in one direction along the connector body and is positively released from locking engagement with the band when the keeper ring is moved in an opposite direction along the connector body. A securement band and locking device which is reversible front to rear and which may include similar or dissimilar decorative treatment of the band and of the connector.

22 Claims, 3 Drawing Sheets

Fig. 1.
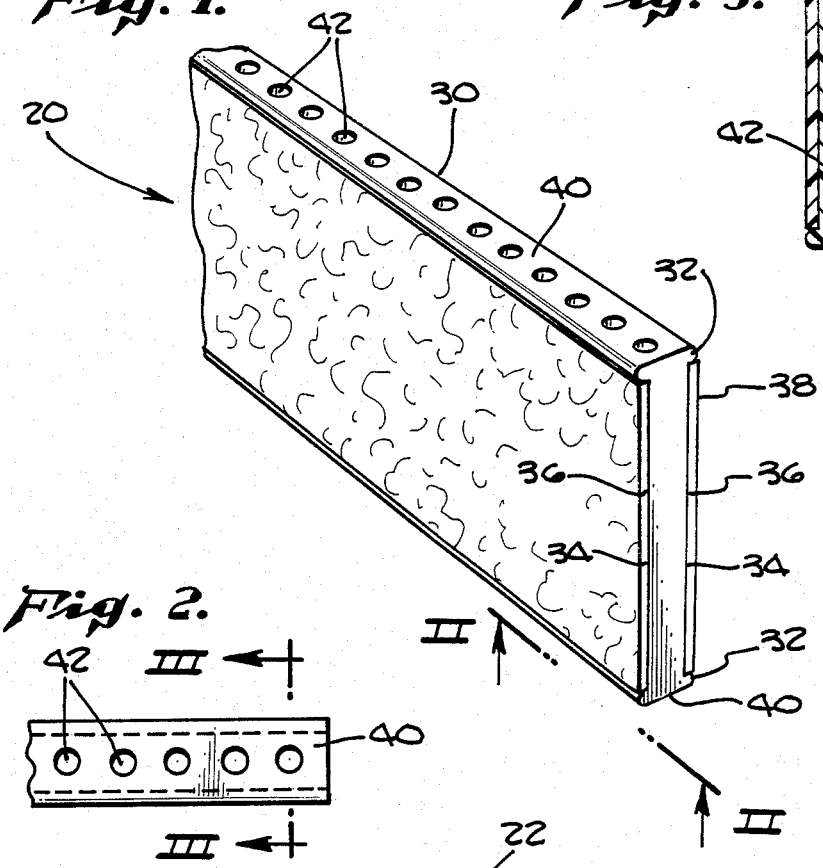
Fig. 3.
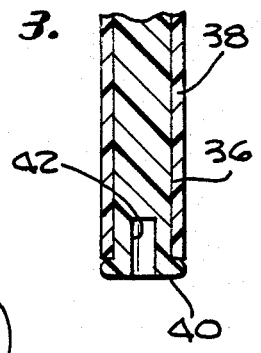
Fig. 2.
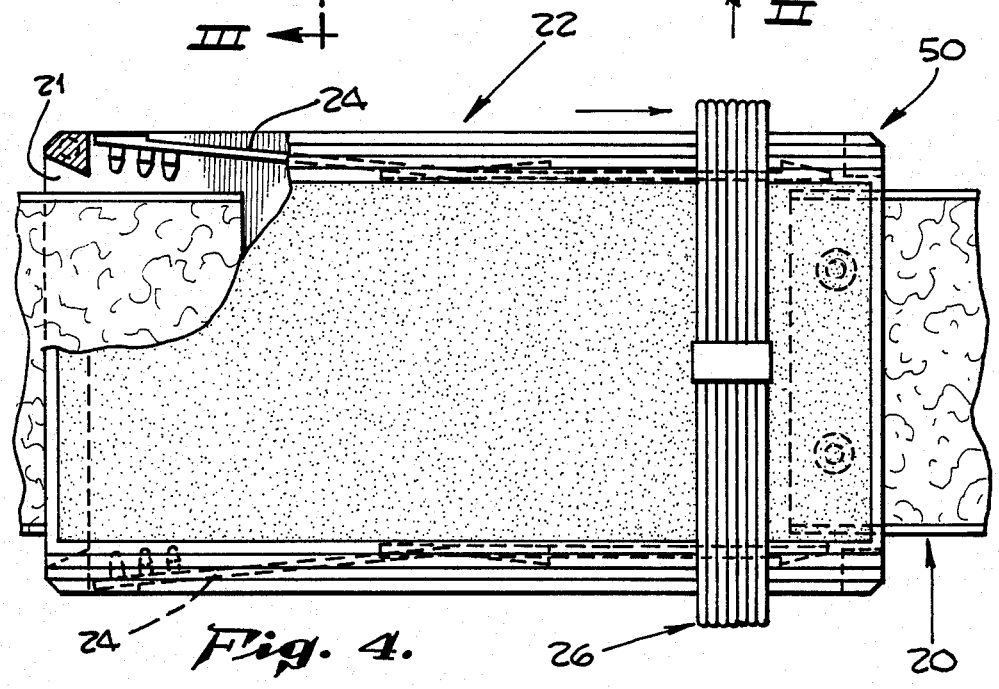
Fig. 4.

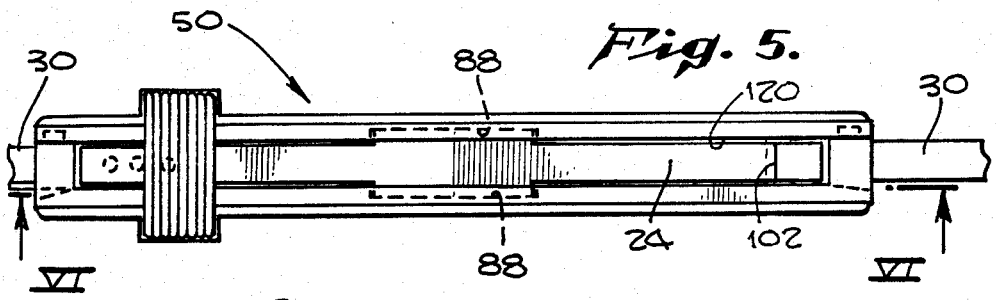
Fig. 5.
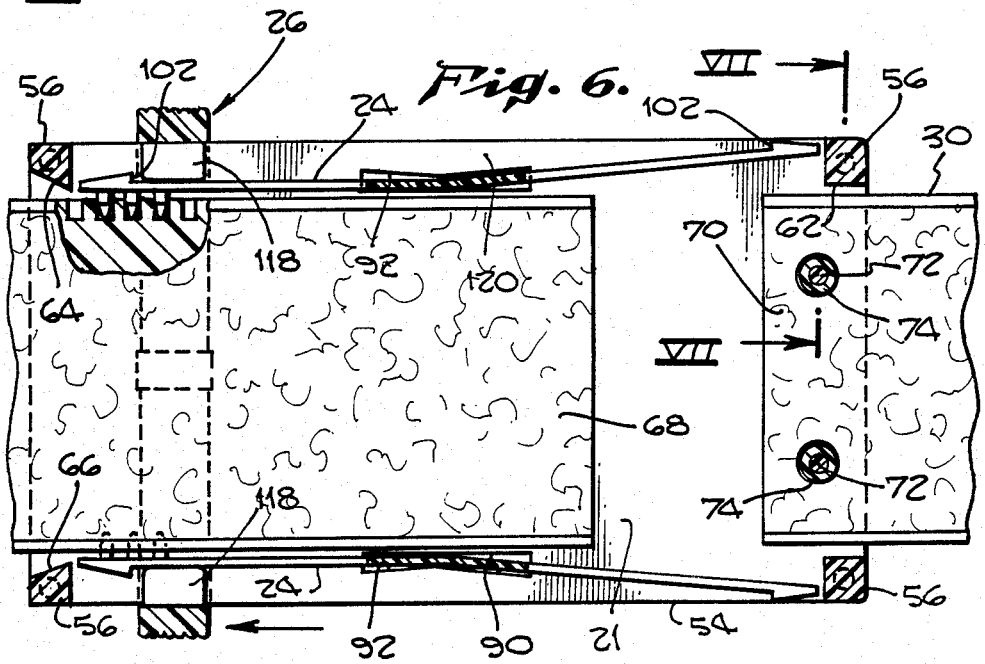
Fig. 6.
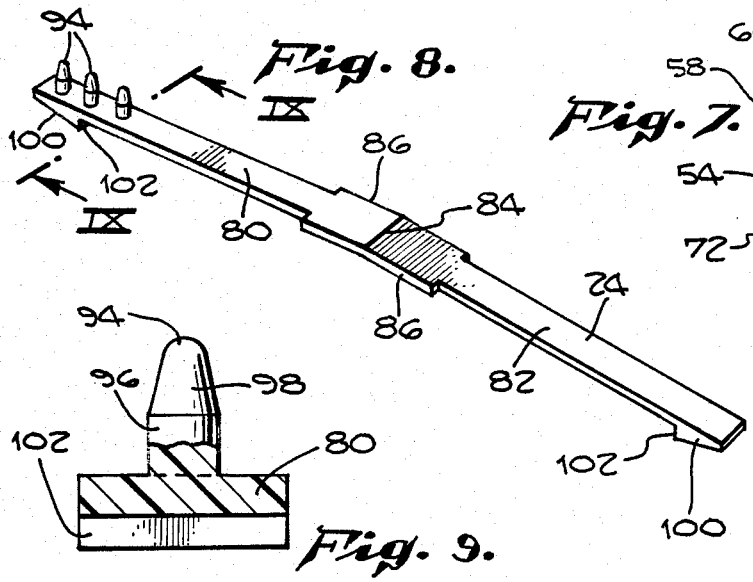
Fig. 8.
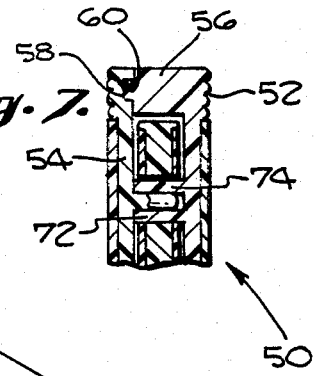
Fig. 7.
Fig. 9.

Fig. 10.
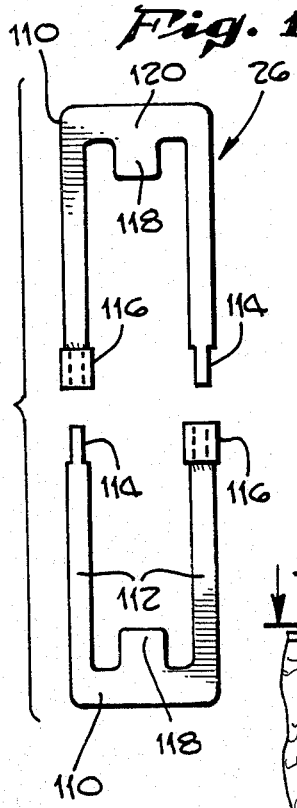
Fig. 13.
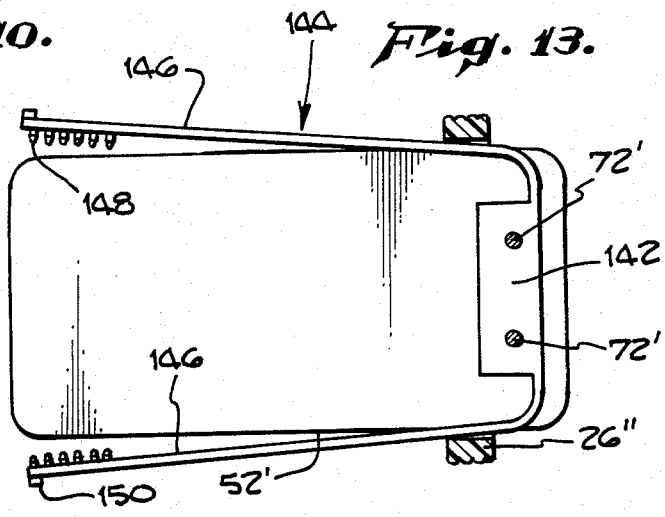
Fig. 11.
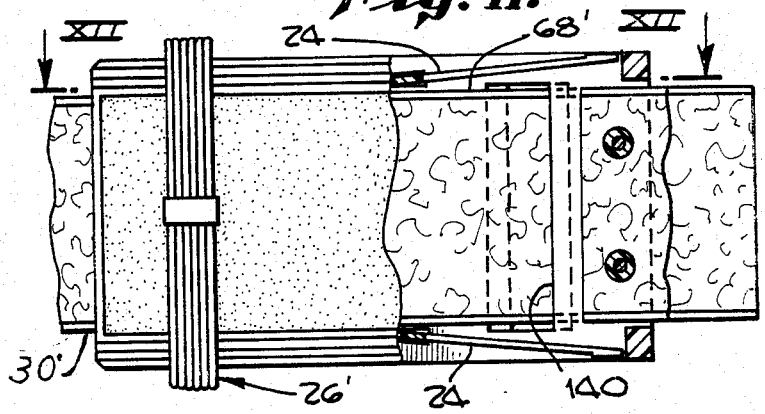
Fig. 12.
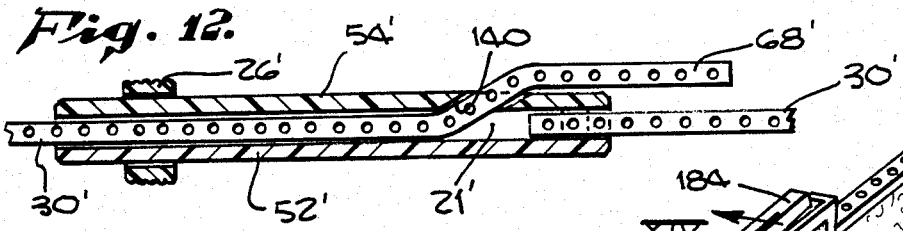
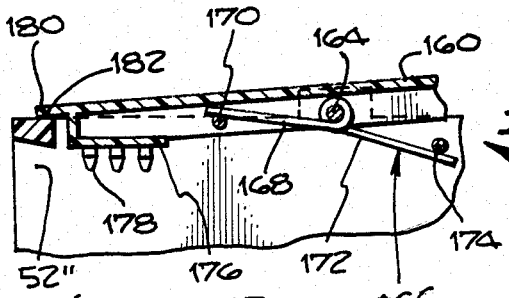
Fig. 15.
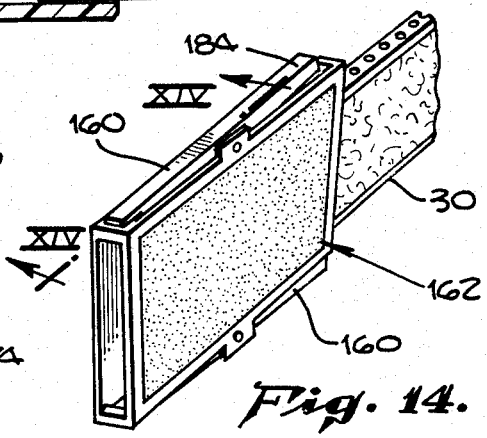
Fig. 14.

SECUREMENT BAND AND CONNECTOR MEANS THEREFOR

BACKGROUND OF THE INVENTION

This invention relates to a securement band and connecting means therefor in which the band is adapted to encircle a body, object or article and to be selectively tightened thereabout and retained in such selected tightened relation. The securement band and connector means for joining opposite end portions of the band are constructed and arranged to provide unique coupling of the band ends and also to provide a universal reversible band and connector receptive of decorative treatment and aesthetic appeal. The securement band and connector means therefor are adapted for use as watch bands, belts for use on apparel, fashion wear and other commercial and industrial fastening applications such as luggage, band clamps and the like.

Prior proposed strap belt or band fastening means have included bands in which a plurality of spaced holes are pierced through one end portion of the band for reception of a hook or tine carried by a buckle. The usually large spacing of the holes in the face of the belt provides adjustability limited to the wide spacing of the belt holes. In such prior proposed belt and buckle arrangements, the free end of the belt is extended beyond the buckle and is either free to flap about the outside of the belt or is long enough to be inserted in a belt loop provided on the article of apparel. In industrial applications such as a band clamp, the metal of the band is provided with relatively large openings which reduces the strength of the metal band and is secured by screw-type or ratchet means which draws the free end of the metal band through a housing in order to tighten the band.

While some prior proposed belt constructions have incorporated material of different color on opposite sides of the belt, the buckle is usually of different material and structure and may be of a neutral color to provide a satisfactory aesthetic effect.

Such prior proposed band-type fastening means in both fashion wear and industrial applications have utilized the side faces of the belt or band to provide means for cooperating with a buckle or coupling or clasp means which utilized the width of the belt to provide such means.

Some proposed buckles, bands, clasps, and coupling means therefor include the following U.S. patents. In U.S. Pat. No. 4,288,892, a buckle is disclosed for joining the ends of a watchband which is provided with longitudinally spaced indentations transversely arranged in the edge of the band, the indentations cooperating with upright teeth on side walls of a coupling member between which the band passes. To interengage the indentations with the teeth on the side walls, the band must be pressed toward the bottom wall of the coupling member by a pressure bar.

In U.S. Pat. No. 215,956, a bracelet is shown in which one end of the bracelet band is provided with edge notches in the form of saw teeth. An external pivoted arm provided with a pin at one end extends through a cap or cover to engage the notches.

Other patents disclosing clasp and band arrangements are U.S. Pat. Nos. 3,385,229; 4,068,355; 2,455,2364,292,692; and 4,577,375.

The above-mentioned U.S. patents disclose generally prior proposed arrangements for coupling together opposite ends of a band and do not contemplate the novel construction of the present invention nor provide the unique advantages of the present invention.

SUMMARY OF INVENTION

The present invention contemplates a novel arrangement of a securement band and connector means therefor in which the edge faces and edge portions of the band and also of the connector means are utilized to provide variable fine adjustment of the band about a body being encircled thereby without disturbance or marring of side surfaces of the band. The invention contemplates a securement band and connector in which both front and back surfaces of the band and connector may be utilized for decorative treatment and thereby providing a multi-purpose band readily adapted for use with different apparel.

It is therefore an object of the present invention to provide a novel securement band and connector means therefor utilizing edge portions of the securement band and connector means in a novel manner.

An object of the invention is to provide a securement band provided with a plurality of lock holes having openings in the longitudinal edge face of the band.

Another object of the invention is to provide the securement band of uniform width and selected length and having continuous uninterrupted side faces for attachment thereto of decorative material.

Still another object of the invention is to provide a connector means for a securement band as mentioned above in which the connector means has a lock member operable along the edge face of the connector means, in concealed relation thereto, and providing fine adjustability of the tightness of the band.

A still further object of the present invention is to provide a connector means having a lock member with lock pins operable along a longitudinal edge portion of the connector means in which the lock member is movable about an axis for movement of the lock pins into and out of locking engagement with the holes in the longitudinal edge faces of the band.

A still further object of the invention is to provide a connector means having a through passageway therein for end portions of a securement band, a lock member at a longitudinal edge portion of the connector means for movement toward and away from the edge of a band contained within the connector means, and a movable keeper means on the connector means for positively actuating the lock member into locked position.

The present invention particularly contemplates a securement device having a securement band with longitudinal edge faces and locking holes in the edge faces, a connector means having a passageway for said band and for reception of the end portions of said band, a lock member with lock pins extending alongside the locking holes at said band edge faces, and a keeper means movable along said connector means for moving the lock member into locking engagement with the locking holes.

Various other objects and advantages of the present invention will be readily apparent from the following description of the drawings in which exemplary embodiments of the invention are shown.

IN THE DRAWINGS

FIG. 1 is a fragmentary perspective view of a securement band embodying this invention.

FIG. 2 is a fragmentary bottom view of the band shown in FIG. 1 taken in the plane indicated by line II—II of FIG. 1.

FIG. 3 is a fragmentary sectional view taken in the plane indicated by line III—III of FIG. 1.

FIG. 4 is an assembled view of the securement band of FIG. 1 with a connecting means, the connecting means being shown in band release position, a portion of the face of the connecting means being broken away to show a free end of the band.

FIG. 5 is a top view of the connecting means and band shown in FIG. 4, the connecting means being shown in locked position.

FIG. 6 is a longitudinal sectional view taken in the plane indicated by line VI—VI of FIG. 5.

FIG. 7 is a fragmentary sectional view of one end of the connecting means, the section being taken in the plane indicated by line VII—VII of FIG. 6.

FIG. 8 is a perspective view of the bottom lock member of the connecting means as shown in FIG. 6.

FIG. 9 is a sectional view taken in the plane indicated by line IX—IX of FIG. 8 to illustrate the shape of one of the lock pins.

FIG. 10 is an exploded view of two identical parts forming the lock and release keeper means of the connecting means, the parts being shown in exploded position prior to assembly.

FIG. 11 is an assembled partially sectional view of a different embodiment of the connecting means of this invention in lock position and with the free end of the band passing through and beyond the connecting means.

FIG. 12 is a fragmentary sectional view of the securement band and connecting means of FIG. 11, the view being taken in the plane indicated by line XII—XII of FIG. 11.

FIG. 13 is a fragmentary view of a still different embodiment of the invention utilizing a spring biassed pivotally mounted locking member.

FIG. 14 is a perspective view of a connecting means and securement band embodying a still different modification of the connecting means.

FIG. 15 is a fragmentary sectional view taken in the plane indicated by line XIV—XIV of FIG. 14.

DETAILED DESCRIPTION OF THE INVENTION

A preferred embodiment of the invention is shown in FIG. 4, in which opposed ends of a securement band 20 are partially inserted within a through passageway 21 of a connecting means 22. Lock members 24 are operable along opposite longitudinal edge faces of the connecting means 22 and are driven into locked and/or released relation with respect to the securement band 20 by a keeper means 26 slidably movable longitudinally of the connecting means 22.

The securement band 20 is shown in detail in FIGS. 1-3. Securement band 20 in this example may comprise a belt 30 or a strap or a suitable elongated strip body member. The material of belt 30 may be an extruded or an injection molded thermoplastic material which is pliant, flexible, and which has a selected tensile strength for the purpose for which it is to be used. Suitable exemplary materials may be polyvinyl chloride, polyethylene, polyesters, neoprene synthetic rubbers, and nylon strips.

The belt 30 in its extruded form has uniform width and thickness. In this example, the belt 30 is provided with longitudinally extending edge ribs 32 along opposite longitudinal edge portions of belt 30 to provide shallow longitudinally extending recesses 34 for the length of the belt 30. Longitudinal recesses 34 provide longitudinally extending belt surfaces 36 to which may be bonded or suitably secured decorative strips 38 by adhesive or other fastening means. Decorative strips 38 may include thin strips of leather, bonded leather, vinyl, other plastic decorative materials, cloth, fabric, or any other suitable thin decorative material. The decorative strip 38 on one side of belt 30 may be of one selected color such as black, and on the other side of belt 30 may be of a selected white color so that the belt may be reversed and readily used with different trousers or apparel.

Longitudinal edge faces 40 of belt 30 are of uniform width, an exemplary width being about $\frac{1}{8}$ of an inch. The edge faces 40 are merged with ribs 32 to provide curved rounded edges. Along the longitudinal edge portions of belt 30 forming longitudinal edge faces 40 are provided a plurality of holes 42 of cylindrical shape with the axes of the cylindrical holes lying generally along a longitudinal plane bisecting the thickness of belt 30. Holes 42 are spaced apart at uniform intervals for the entire length of belt 30. Each hole 42 may be approximately 0.080 inches in depth and approximately 0.046 inches in diameter. The holes 42 in the longitudinal edge faces of belt 30 are not readily apparent in wearing of a belt 30 and do not distract from the decorative patterns which may be applied to the side surfaces 36 of the belt or from the general appearance of the belt.

Holes 42 may be readily formed in belt 30 during the extrusion of belt 30 and while the belt material is hot. A hot extruded belt 30 may be passed between a pair of matching gears, one on each side of belt 30. During passage of the belt between such a set of gears having the desired size and shape of gear teeth, the gear teeth will readily penetrate the edge face of the belt and form holes at selected uniform intervals along the edge face of the hot belt. The holes in both edge faces are formed in transverse alignment.

Another method of forming holes 42 in the edge face of a belt may comprise placing the hot belt material in a press in which one or both sides of the press is provided with longitudinally aligned and spaced press pins which upon moving transversely of the belt will penetrate under pressure the longitudinal edge faces of belt 30 to form the holes 42. It will be understood that other methods may be used to form holes such as 42 or their equivalent in the longitudinal edge faces 40 of Belt 30 may be made in any suitable selected length and when utilized as hereinafter described, may be readily cut to a selected length.

The clasp, buckle, coupling or connecting means 22 is best shown in FIGS. 4, 5, 6 and 7. Connecting means 22 may comprise a connector body generally indicated at 50 and comprises two body plates 52 and 54 of similar shape and size. Both plates 52 and 54, in this example, are of corresponding rectangular configuration. At each end, plate 52 is provided with a pair of end abutments 56, each having a transversely extending projection 58 adapted to be received within a mating socket 60 formed in the end portion of body plate 54. The two body plates 52 and 54 thus form a longitudinally extending through passageway 21 having an opening 62 at one end of the connector body. At the other end of the connector body a through opening 64 is provided; the interior surfaces of the adjacent abutments 56 being provided with outwardly flaring surfaces 66 to facilitate entry of a free end 68 of securement belt 30. The interengagement of each projection 58 in socket 60 may include a plastic type frictional fit to hold the two body plates in assembly and may be further secured, if desired, by adhesive.

As shown in FIG. 7, the other fixed end 70 of belt 30 is secured by sockets 72 formed on body plate 52 adjacent the open end 62. The fixed end of belt 30 is provided with a pair of openings 74 spaced apart and alignable with sockets 72 so that upon inserting the end to be fixed of belt 30 into opening 62 the openings 74 in the belt 30 may be registered with sockets 72. Upon assembly of body plate 54 with plate 52 as by moving the plates in alignment toward each other into pressure friction engagement of projections 58 and sockets 60, the end of belt 30 is thus fixedly secured to the connecting means 22.

Connecting means 22 also includes an elongated barlike lock member 24 which is shown in detail in FIG. 8. Lock member 24 includes a lock portion 80 and a release portion 82, such portions being straight and joined in slightly obtuse angular relation at a vertex 84. Adjacent vertex 84 lock portions 80 and 82 are provided with outwardly extending correspondingly angularly related flanges 86 adapted to be received within recesses 88 provided in opposed relation in body plates 52 and 54. Each of recesses 88 include a straight inboard edge wall 90 and angularly related recess walls 92 opposite to straight wall 90. Lock member 24 is assembled with the connector body plates 52 and 54 when the plates are separated so that the flanges 86 may be received within the recesses 88. As the two body plates are pressed together, lock members 24 are rockingly held in the edge opening 120 adjacent to longitudinal edge faces of the connector means on both sides thereof as shown in FIG. 6. It will be apparent from FIG. 6 that the angularly related recess faces 92 in recess 88 limit rocking movement of the lock member 24 when assembled with the connector body plates 52 and 54 so that ends of the lock bar will not project above longitudinal edges of the connector body 50.

At one end of each lock bar member 24 are provided a plurality of lock pins 94 in uniform spaced relationship corresponding to the spacing of holes 42 in the edge face of belt 30. As shown in FIG. 9, each pin 94 comprises a cylindrical base portion 96 and a tapered end portion 98 which facilitates entry of the pin into the holes 42. The diameter of the cylindrical base portion of lock pin 94 may be approximately 0.040 inches, which is slightly smaller than the 0.046 inches diameter of hole 42 to facilitate sliding entry of the lock pins 94 into the holes 42 when the lock member is moved into locked position. Each pin 94 may have a pointed shape, such as a saw tooth adapted to form a pierced hole in the edge face.

At opposite ends of lock member 24 and on the face opposite to the location of pins 94, the remote ends of each lock part 80 and 82 are provided with an enlargement 100 to provide an inboardly facing stop face 102 for a keeper means 26.

Keeper means 26 may be best seen and described in FIG. 10 in which the keeper means comprises a pair of identical U-shaped plastic members 110 having a pair of parallel legs 112, one of said legs 112 being provided with a reduced diameter pin 114. The other leg 112 is provided with an enlarged socket 116 adapted to receive pin 114 of the opposite part 110 of the keeper means 26. It will be apparent from FIG. 10 that when the keeper means 26 is assembled with the connector body the two parts 110 embrace opposite sides of the connector body and as they are moved towards each other, they will be assembled with pins 114 in sockets 116 and in assembled relation with the connector body.

Each keeper U-shaped member 110 includes an internal actuator or guide lug 118 centrally located between legs 112 and extending toward the open end of said legs from transverse base 120 of the keeper means. When the keeper means 26 is assembled with the connector body, the guide lugs 118 are received within the longitudinally extending edge opening 120 outwardly of or above lock member 24. Edge opening 120 is formed by assembly of the body plates 52 and 54. Guide lug 118 slidably contacts the outboard surface 124 of lock member 22. As seen in FIG. 6, when the keeper means 26 is moved to the left in FIG. 6, guide lug 118 causes the lock member to depress its lock part 80 and to drive lock pins 94 into recesses 42 of a free belt end which has been inserted through the opening 66. In such movement because of the angular relation of lock parts 80 and 82, the tapered portion 98 of each pin will seek the opening of an opposed hole 42 and as the keeper member 26 drives the lock part 80 into parallel relation with the edge face of the free belt end and with the edge of the connector body, the cylindrical base of the lock pins 94 will be driven into close locking engagement with at least three holes 42 as illustrated in FIG. 6.

To release lock member 24, the keeper means 26 is moved to the right in FIG. 6 and as it is moved, the guide lugs 118 travel in slidable engagement along the outboard surface 124 of the lock member until the release part 82 is driven into parallel relation with the edge of the connector body and the edge of the base. The keeper means 26 is then in the position shown in FIG. 4 where the lock member has been rocked about its vertex 84 to lift the pins 94 out of engagement with the holes 42. The lugs 118 on the keeper means are limited in their movement longitudinally of the connector body by the stop faces 102 at ends of the lock member 24 as shown in FIG. 6.

As best seen in FIGS. 4 and 6, the free end 68 of belt 30 may be inserted in the passageway 21 of the connector means until it moves into abutment with the fixed end 70 of belt 30. In the event the body encircled by the securement band 30 is small and the band is loose, the free end 68 may be withdrawn from the connector body and may be readily cut off to a selected length. The free end 68 is then inserted within the connector body in spaced relation to the fixed end 70 under conditions where the belt 30 is in desired tightness about the encircled body. Since the holes 42 may be located along the entire length of the edge faces of the belt, adjustment of the length of the belt to a selected length and tightness is readily accomplished.

It has been described above that the belt 30 is provided with decorative strips 38 on its opposite faces for the entire length of the belt. Connecting means 22 may be provided with decorative strips 134 on the opposite surfaces 130 and 132 of body plates 52, 54. Decorative strips 134 may correspond to the decorative strips 38 provided on the belt or may be formed of a different type of material if it is desired to accentuate the appearance of connecting means 22. When the decorative strips 38 and 134 are the same, it is will be apparent that the belt 30 and connecting means 22 generally have the same configuration and appearance.

In the modification of the invention shown in FIGS. 11 and 12, for purposes of brevity, only the differences in the connecting means will be described. In FIG. 11, the belt 30' has a free end 68' which is passed through a slot 140 formed in this example in body plate 54. Slot 140 has opposed beveled surfaces to facilitate the passage through the opening of slot 140 of the free end 68' of the belt 30'.

This modification of the connecting mean permits the securement belt 30' to be of a length which will exceed the normally selected length which requires termination of end 68 in the connecting means 22. Thus, belt 68' may be employed for encirclement of articles or bodies of widely different circumference. Since holes 42 are continuous along the length of the belt 30', the locking function may be effected at any location along the length of the belt. It will also be understood that the free belt end 68, may be worn interiorly of the belt main portion adjacent to the connecting means 22 or, if desired, the connecting means 22 may be reversed and the belt portion free end 68, may be exteriorly positioned of the belt 30, In FIG. 13, a still different modification of the connecting means is illustrated, only a portion of the connecting means being shown. In this embodiment, one of the body plates such as 52" may have attached thereto at the sockets 72" a base 142 of a U-shaped locking spring means 144. Locking spring means 144 includes a pair of normally outboardly biased locking arms 146 which include on their inboard free end surfaces a plurality of locking pins 148. Fixed and free ends of a belt are assembled within the connecting means as in the prior embodiment. When the keeper means 26" is moved to the left as shown in FIG. 11, it will be apparent that keeper 26" will cause the outboardly biased lock arms 146 to be urged inwardly to engage the lock pins 148 with the openings 42 in the edge of the belt 30 within the connecting means as in the prior embodiment.

When the keeper means 26" is moved to the right as shown in FIG. 13, the spring biased force in the spring arms 146 causes the arms to release lock pins 148 from engagement with holes 42 in the edge of the belt.

In the event such automatic spring biased release does not occur when the keeper means 26 is moved to release position, each free end of each lock arm 146 may be provided with an outwardly directed tab 150 which may be grasped to facilitate such release and which also acts as a stop for movement of the keeper means 26' at its full locked position.

In a still further embodiment of the invention as shown in FIGS. 14, 15, locking arm means 160 at each edge of the connecting means 162 may be pivotally mounted about a transverse pin 164 centrally of the length of the connecting means. Lock arm 160 is biased into locking position as shown FIG. 15 by a spring means 166 having a spring arm 168 bearing against a pin 170 carried internally of lock arm 160. The opposite leg 172 of spring 166 bears against a pin 174 carried by one of the connector body plates such as 52".

Lock means 160 may have a channel section body and is provided with an inturned flange 176 provided with inwardly directed lock pins 178 for locking engagement with the edge holes of a belt 30 such as described in the first embodiment. The lock means 160 includes an extension lip 180 which bears against a surface 182 of plate 52" at its corner to limit pivotal movement of lock means 160 about pin 164.

The opposite end 184 of look means 160 is raised above the edge faces of the connecting means 162 when the lock means is in locked position. Release of the lock member 160 from engagement with the belt is accomplished by pressing downwardly on the lock arm end 184 to release locking pins 178 against the bias of the spring 166.

The advantages of the securement band and connecting means of this invention as described above will be readily apparent to those skilled in the art. The locking holes 42 in the longitudinal edges of the belt are almost invisible and are normally not noticeable. The locking holes 42 do not weaken the belt since there is substantial material between the edges of the belt which has not been reduced by holes or perforations. With respect to the first embodiment which is the preferred embodiment, the locking arm is essentially concealed along the longitudinal edges of the connecting means. The limited rocking movement of the locking member is also not visible and the sliding movement of the keeper means from one end of the connecting means to the other provides positive movement of the locking member into locking engagement with the belt and also into released position with the locking pins positively withdrawn from the edge of the belt. In some instances, it will be understood that the locking belt and the connecting means may be provided with locking holes along jut one edge of the belt and the along the corresponding edge of the connector body for engagement with the belt.

The length of the belt is readily closely adjustable to a selected precise length because the spacing of the holes is relatively close. The length of the connector body may be any selected length and adjustment of the length of the belt to provide a free end terminating within the connector body provides normally sufficient end play to provide a readily acceptable adjustable tightness of the belt.

When the material selected for the band is rubber-like and relatively soft, pre-formed holes in the band edge face may be omitted and the holes in the edge face may be formed by piercing movement of the lock pins of saw-like form on the lock member into locked position. Upon movement of the lock member into release position and the retraction of the lock pins from the holes made thereby, the memory of the material along the edge face will cause the pierced holes to substantially disappear.

It should also be noted that adjustment of the belt once a selected length has been cut may be readily made without removing the free end of the belt from the connector body. The keeper means is moved to release position. The free end of the belt is moved within the connector body to its new selected position and then the keeper means is moved to the belt locked position. This is accomplished without withdrawing the free end of the belt from the connector body.

In the preferred embodiment as shown in FIGS. 1–7, there is no exposed free belt end and, therefore, there is continuity of appearance of the belt throughout its length. In the second embodiment of the invention shown in FIGS. 11, 12, a free extended end portion of the belt is provided in the event it is not desired to terminate the free end of the belt within the connector body.

It will be readily apparent from the above description that the present invention provides a unique, attractive, streamlined belt for use with clothing apparel. The concept of the invention is not limited to use with clothing apparel and it would be readily apparent that by suitably proportioning the width length and thickness dimensions of the band, the provision of at least a plurality of holes along at least a selected length portion of the band and the connector means the device of this invention has utility with respect to watchbands, bracelets, and industrial applications such as a band clamp, cinch-type fastening means and other like purposes since the band is capable of minute adjustments along its length and such adjustments are readily accomplished by reason of the plurality of closely spaced edge holes in the band and the arrangement of lock member and keeper means with the connector body. While the above description has referred to a band of flexible characteristics, it will be understood that a portion of the length of the band may be of relatively rigid material in which the plurality of edge holes may be made in a relatively rigid length portion of the band since such variation may have utility with respect to industrial applications of the securement band and connector means.

Various modifications and changes may be made in the securement device described above that come within the spirit of this invention and all such changes and modifications coming within the scope of the appended claims are embraced thereby.

I claim:

1. A securement device comprising, in combination:

a securement band of selected length and uninterrupted width having longitudinal edge faces;

locking holes having openings in said edge faces;

a connector means having a passageway for reception of end portions of said band;

means on said connector means including an elongated lock member having lock means and extending over said locking holes at said band edge faces of band portions received within said passageway;

and means movable along said connector means for contacting said lock member and pressing said lock means into said opening and into locking engagement with said locking holes.

2. A securement device as claimed in claim including means on said connector means cooperable with means on said lock member for rocking movement of the lock member into lock and release positions.

3. A device as claimed in claim 1 including one or more lock pins on said lock member for reception within said locking holes on said band.

4. A device as claimed in claim 1 wherein said securement band is provided with continuous longitudinally extending uninterrupted side surfaces;

and decorative strip material attached to one or both side surfaces of said band.

5. A device as claimed in claim 1 wherein said connector means includes uninterrupted side surfaces lying parallel to the side surfaces of said band;

and decorative strip material attached to the side surfaces of said connector means.

6. A device as claimed in claim 1 including stop means at opposite ends of said lock member;

and means on said movable means cooperable with said stop means for limiting travel of said movable means along said connector means.

7. A device as claimed in claim 1 wherein said movable means includes a keeper member encircling said connector means;

said keeper member including an inwardly directed lug opposite said lock member and adapted to slidably engage said lock member along the length thereof for positive actuation of said lock member into lock and release positions.

8. A device as claimed in claim 1 wherein said connector means includes a pair of connector body plates defining said passageway each plate having a centrally located recess, with a angularly disposed recess surface;

said lock member having oppositely directed sidewardly extended flanges receivable within said recesses for holding said lock member in assembly with said connector body plates.

9. A device as claimed in claim 9 wherein said lock member includes angularly related lock and release portions extending away from said central portion and providing a vertex at said flanges for rocking movement of said lock member within the limits of said recess surfaces on said body plates.

10. A connector means for a securement band comprising, in combination:

a pair of connector body plates of polygonal configuration providing a through passageway having end openings and at least one external longitudinally extending edge opening extending between said end openings;

a lock member extending along said one edge opening and having lock pins thereon;

means mounting said lock member on said body plates for limited pivotal motion about a transverse axis to move said lock member toward and away from said passageway;

and means slidably movable along said connector plates for contact with said lock member for actuation of said lock member into locked position.

11. A connector means as claimed in claim 10 wherein said lock member is biased into released position.

12. A connector means as claimed in claim 10 including stop means at one end of said lock member for limiting movement of said movable means along said connector body plates.

13. A connector means as claimed in claim wherein one of said connector body plates is provided with a side opening communicating with said passageway.

14. A connector means as claimed in claim 15 wherein said movable means includes a ring-like keeper member encircling said connector body plates, said keeper member including an inwardly directed lug movable along said one edge opening for contact with said lock member.

15. A connector means as claimed in claim 10 wherein said lock member is contained and concealed within said one edge opening.

16. A reversible securement device comprising in combination:

a securement band having at least one end portion provided with a longitudinally extending edge face lying normal to the plane of the band;

a plurality of spaced holes in said band edge face having axes lying normal to the edge face.

a connector means having a connector body with a passageway for receiving end portions of said band at opposite ends of said passageway;

said connector body having body edge faces lying in the same planar zone as said band, said body including a longitudinal opening in at least one body edge face in proximity to the band edge face provided with said edge holes;

a lock member in the longitudinal opening in said connector body edge face, said lock member having lock pins; and actuator means carried by said connector body and movable along said longitudinal opening for moving said lock member into releasable locking engagement with said holes in the band edge face.

17. A device as claimed in claim 16 wherein said lock member includes lock portions forming a shallow obtuse angle;

and means on said connector body at said longitudinal edge opening for limiting rocking movement of said lock member about the vertex of said angle.

18. A device as claimed in claim 16 wherein said actuator means movable along said longitudinal edge opening of said connector body includes a keeper ring slidably movable along said connector means and engageable with said lock member for urging said lock member pins into engagement with said holes in said band edge face.

19. A securement device comprising, in combination:

a securement band of selected length, width, and thickness, and of selected rubber-like material having longitudinal edge faces the width of the thickness of the band;

a connector means having a passageway for said band and for reception of end portions of said band;

means of said connector means including an elongated lock member extending over one of said band edge faces of band portions received within said passageway;

said lock member having pointed lock pins adapted to pierce said edge face in locked position;

and means movable along said connector means for moving said lock pins into piercing engagement with said edge face.

20. A securement device as claimed in claim 19 wherein said rubber-like material is a thermoplastic material.

21. A securement device comprising in combination:

a securement band of relatively soft, pliant, flexible material having at least one edge portion provided with a longitudinally extending edge face lying normal to the plane of the band;

a connector means having a connector body with a passageway for receiving end portions of said band at opposite ends of said passageway;

said connector body having body edge faces lying in the same planar zone as said band, said body including a longitudinal opening in at least one body edge face in proximity to the band edge;

a lock member in the longitudinal opening in said connector body edge face, said lock member having lock pins;

and actuator means carried by said connector body and movable along said longitudinal opening for moving said lock member into releasable locking engagement with said band edge face.

22. A securement device as claimed in claim 21 wherein;

said actuator means is movable in one direction for moving said lock member with said lock pins into piercing engagement with said band edge face to temporarily form holes in said band, said actuator means being movable in the opposite direction for retraction of said pins from said band edge face for release of said connector means.

* * * * *